US005881873A

United States Patent [19]

Hsi-Chang

[11] Patent Number: 5,881,873

[45] Date of Patent: Mar. 16, 1999

[54] FOLDED CARDBORD ARTICLE FOR PACKAGING STIRRUPS

[75] Inventor: Chang Hsi-Chang, Taichung, Taiwan

[73] Assignee: Eastwest International (Taiwan) Enterprises, Taiwan

[21] Appl. No.: 3,425

[22] Filed: Jan. 6, 1998

[51] Int. Cl.[6] ..... B65D 85/20

[52] U.S. Cl. ..... 206/315.1; 206/493; 294/159; 294/163

[58] Field of Search ..... 206/315.1, 493, 206/495; 53/397, 409; 294/158, 162, 163, 159

[56] References Cited

U.S. PATENT DOCUMENTS

| | | | |
|---|---|---|---|
| 3,563,432 | 2/1971 | Sage | 294/159 |
| 3,804,309 | 4/1974 | Kwak | 294/159 |
| 4,778,210 | 10/1988 | Paulson | 209/493 |
| 5,184,728 | 2/1993 | Wile | 206/493 |

FOREIGN PATENT DOCUMENTS

| | | | |
|---|---|---|---|
| 2163949 | 3/1986 | United Kingdom | 294/159 |

*Primary Examiner*—David T. Fidei
*Attorney, Agent, or Firm*—Antonio R. Durando

[57] ABSTRACT

A single-piece cardboard sheet into which slots and tabs are advantageously cut to permit its folding into a carton for packaging a pair of stirrups. The unfolded cardboard carton is substantially symmetrical. A first pair of structural segments projects in opposite directions along the longitudinal axis of the carton, each segment comprising an elongated tab with a distal end sized to fit within a slot in the top section. Two lateral cuts are provided in each elongated tab. A second pair of structural segments projects in opposite directions along the transverse axis of the carton, each segment comprising a separation section with a distal slit cut along its axis. The stirrups are packaged by folding the tabs downward, inward and upward through the slot in the top section, thereby wrapping around the stirrups, folding the separation section between the stirrups, and latching the slits in the separation sections to the lateral cuts in the elongated tabs.

17 Claims, 4 Drawing Sheets

FOLDED CARDBORD ARTICLE FOR PACKAGING STIRRUPS

BACKGROUND OF THE INVENTION

1. Field of the Invention

This invention is related in general to the field of packaging and displaying of commercial articles. In particular, the invention consists of a novel cardboard carton for packaging and displaying stirrups.

2. Description of the Related Art

It is desirable to package and market products so that they are visible and easily placed on a shelf, preferably hanging from a display hook. In addition, it is desirable to package products in a relatively inexpensive container or carton. In the case of stirrups for horse-back riding, it is also useful if the packaging makes it possible for a potential buyer to touch and feel the stirrups, and try them on the footwear for which they are intended. Accordingly, it is important that the package be suitable for easy opening and removal of the stirrups, and further for easy reassembly into an undamaged package.

Products are often packaged in folded cardboard structures especially designed for the task at hand. Typically, the carton is produced by shaping a flat cardboard sheet to fit the dimensions of the article to be packaged and by cutting appropriate tabs, slits and slots to form the carton around the article. The present invention relates to a novel cardboard structure for packaging stirrups.

A stirrup is a frame or ring attached to a riding saddle by a strap for receiving the foot of a rider and used to aid in mounting and as a support while riding. Typically, stirrups have a lower, flat foot-tread or foot-pad portion connected to the ends of two branches of a curved, inverted U-shaped structure that completes the ring attached to the strap. An eye or slot is provided at the top of the curved structure for receiving the supporting strap of the saddle. Because stirrups come in pairs and are made of heavy, solid metal, they are not easily packaged in convenient form. They are usually displayed in plastic bags or loosely on a rack.

Therefore, it would be desirable to have an inexpensive and practical packaging cardboard structure for containing and displaying a pair of stirrups visibly on a shelf. This invention is directed at a simple device for achieving that purpose.

BRIEF SUMMARY OF THE INVENTION

One primary goal of this invention is a cardboard structure for packaging a pair of stirrups for display on a shelf or a rack.

Another goal of the invention is a packaging structure that is folded around a pair of stirrups to form a package suitable for display.

Another objective is a package that can be assembled around a pair of stirrups simply and quickly.

Finally, an objective of the invention is a device that is inexpensively manufactured from material readily available in commerce, preferably cardboard.

Therefore, according to these and other objectives, the present invention consists of a piece of cardboard sheet or equivalent material with slots and tabs strategically cut to permit its folding into a carton for packaging a pair of stirrups. The unfolded cardboard carton is substantially symmetrical with respect to both its major and minor axes and comprises a central or top section from which two pairs of equal structural segments project outwards. Each of the first pair of structural segments projects in opposite directions along the longitudinal axis of the unfolded carton and comprises a proximal section of increasing width defining a substantially trapezoidal shape; a substantially rectangular intermediate section connected to the wider base of the trapezoid; and a substantially rectangular elongated tab connected to the intermediate section and with a distal end sized to fit within a commensurately long slot in the central section. A straight folding line defines the separation between sections and two lateral cuts are provided in the elongated tabs along the line separating them from the intermediate sections. Each of the second pair of structural segments projects outwardly from the central section in opposite directions along the transverse axis of the unfolded carton and comprises a proximal section of decreasing width defining a substantially trapezoidal shape; and a substantially rectangular end section, connected to the narrower base of the trapezoid, with a distal slit cut along its axis. A straight folding line also separates these sections. Finally, each distal end of the elongated tabs contains a catch or hanging hole suitable for receiving a hook of a display rack.

In use, each segment of the carton is folded downward and inward from the central section such that each section forms an approximate right angle along the folding line with each adjacent sections. The stirrups are packaged by looping each of the first pair of structural segments of the carton (the longitudinal segments) around the top of the inverted U-shaped structure of a stirrup and by passing the converging elongated tabs upwards through the slot in the central section to protrude from the top thereof, thereby forming two supporting loops for the pair of stirrups. Each of the second pair of structural segments of the carton (the transverse segments) is then folded downward between the tops of the stirrups, thereby forming a partition between them to keep them in snug alignment within the package, and the distal slits in the end sections are coupled in frictional engagement with the lateral cuts in the elongated tabs. By making the effective width of these lateral cuts slightly less than the thickness of the material constituting the carton, their engagement with the distal slits is pressed fit and provides sufficient retention to maintain the shape of the carton during use. The hole in the distal ends of the elongated tabs protruding upwards from the central section is available for hanging the assembled carton on a hook.

Thus, a pair of stirrups packaged according to the invention is visible to a potential buyer (see FIG. 2), is accessible for touching while still within the package, and is easily removable from the carton to see whether it fits the buyer's boot. Once taken apart, the carton can be reused to repackage the spur easily and without damage, if necessary.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose but one of the various ways in which the invention may be practiced.

DESCRIPTION OF THE PREFERRED EMBODIMENTS OF THE INVENTION

This invention is based on the idea of utilizing a single-piece cardboard structure to produce a foldable carton suitable for advantageously packaging and displaying a pair of stirrups. The design of the cardboard article makes it possible to securely package the stirrups in a single bundle by simply folding the article's two longitudinal segments downward from the central section, looping each of them inward around the ring of a stirrup, and passing the distal end of each elongated tab upward through the slot in the central section.

Figure 1:
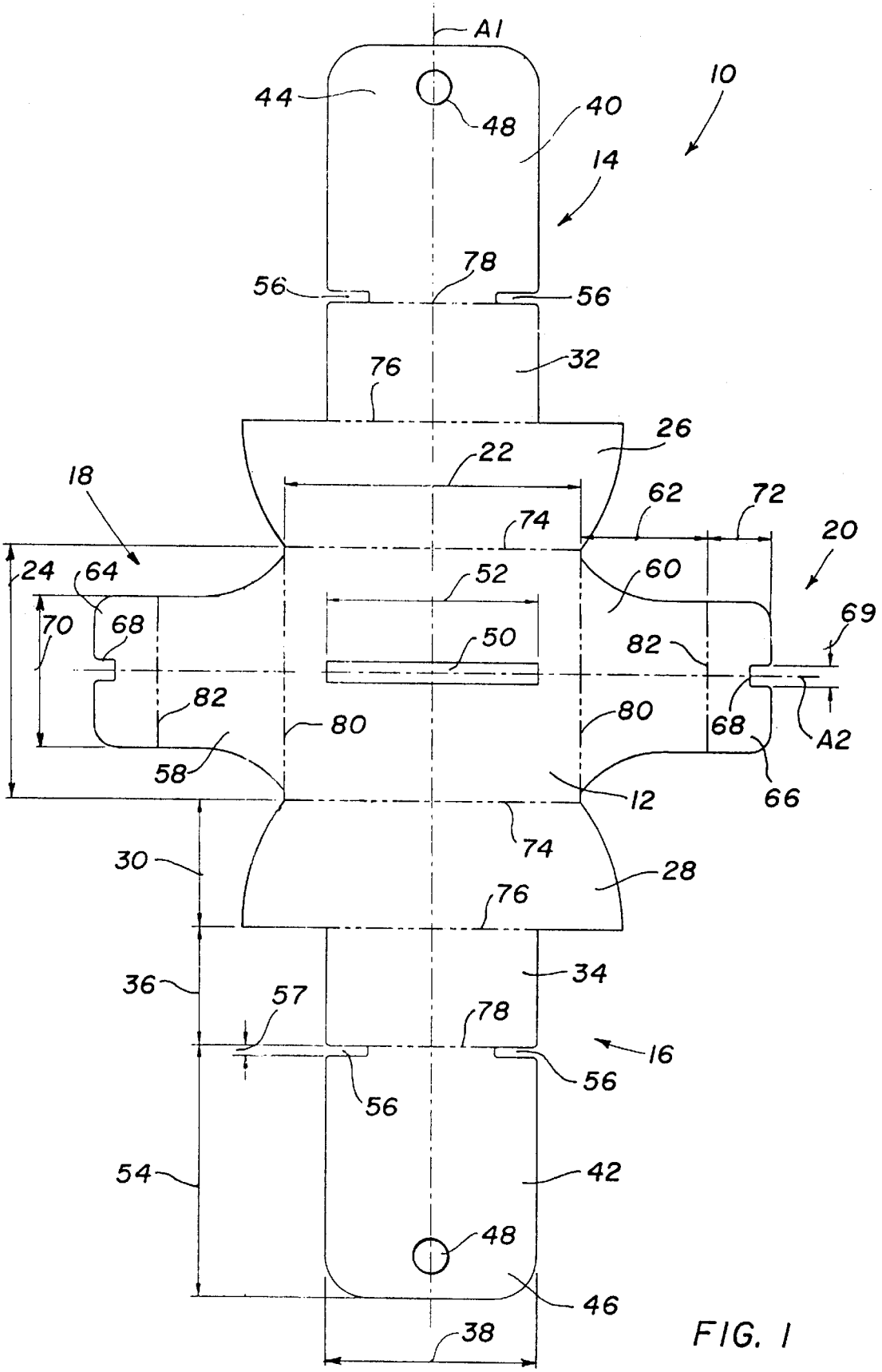
FIG. 1 is a plan view of a flat cardboard sheet cut to obtain a foldable packaging carton according to the preferred embodiment of the invention.

Referring to the figures, wherein like parts are designated by like reference numerals and symbols, FIG. 1 is a plan view of a flat, unfolded cardboard packaging article or carton 10 according to the invention. The carton comprises four separate segments connected to a central or top section 12. The top and bottom segments 14 and 16 (longitudinal segments) project along the longitudinal axis A1 of the unfolded carton; and the lateral segments 18 and 20 project along the transverse axis A2 of the unfolded carton. Both segments in each pair are substantially identical and are disposed symmetrically with respect to the central section 12. Therefore, the details of the segments in each pair are described together. The terms central and top; proximal and front or back or side; and intermediate and bottom are used interchangeably throughout to refer to the same sections in unfolded and folded configurations, respectively.

Figure 2:
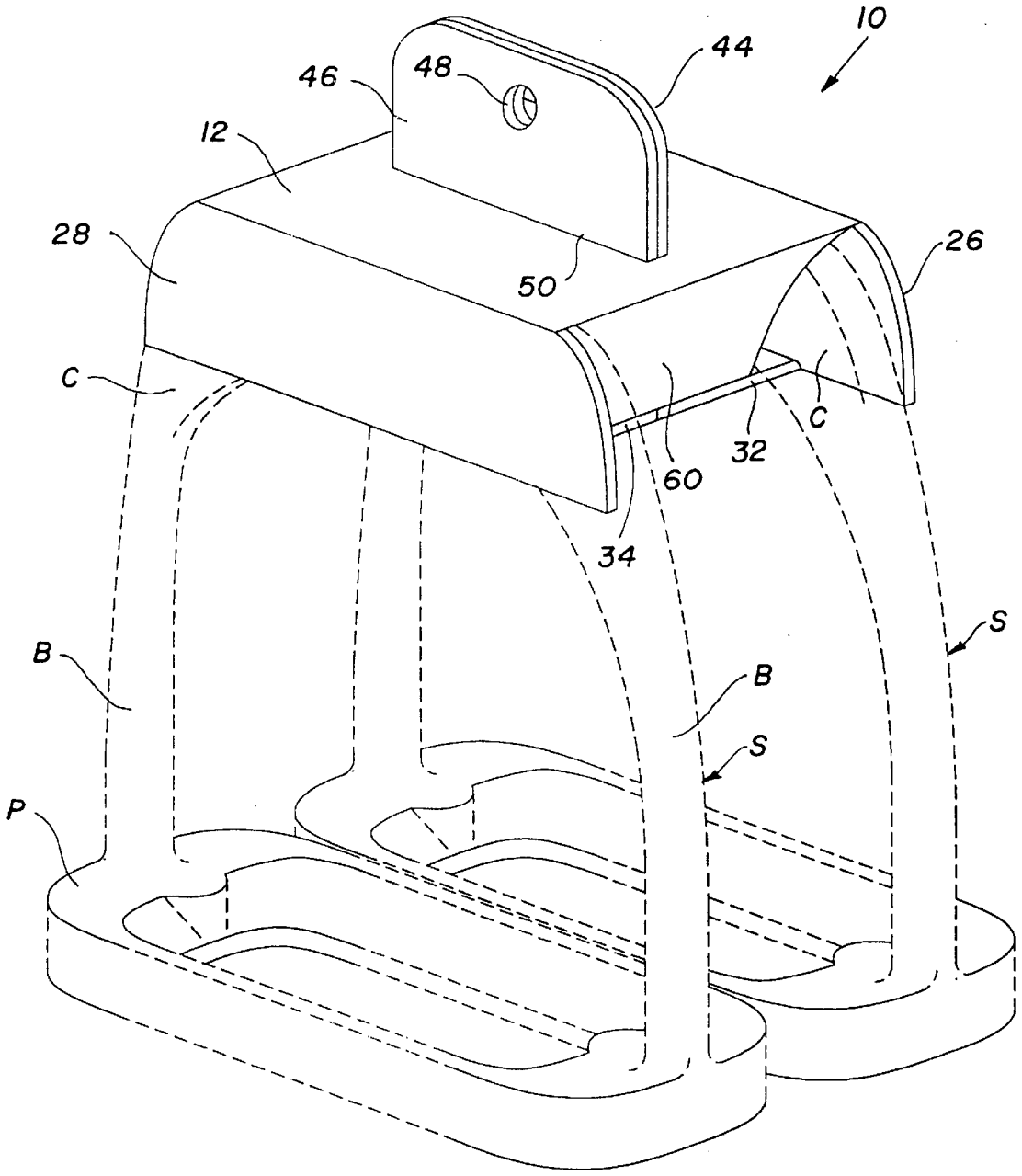
FIG. 2 is a perspective view of the carton of the invention after folding around a pair of stirrups to produce a packaged product.
Figure 3:
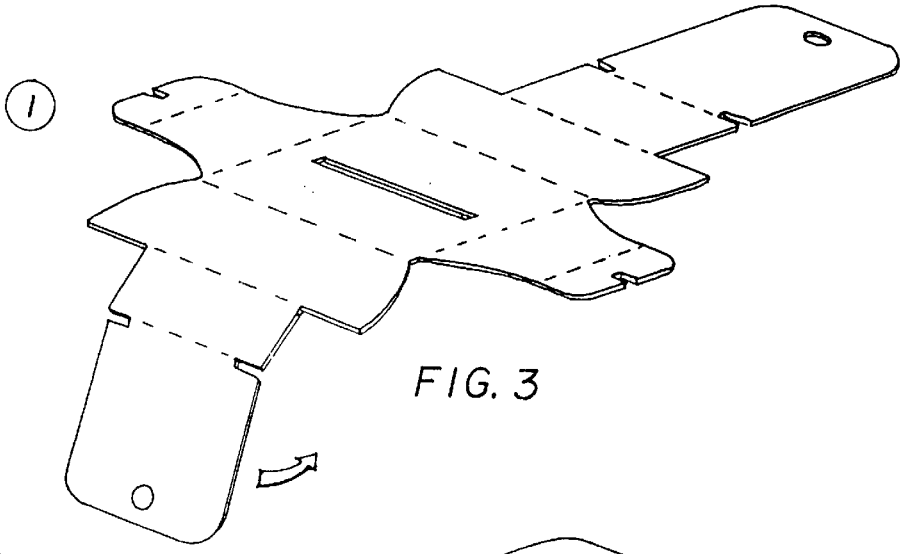
FIG. 3 is a perspective view of the carton of the invention illustrating the initial steps of folding one of the longitudinal segments downward and inward.
Figure 4:
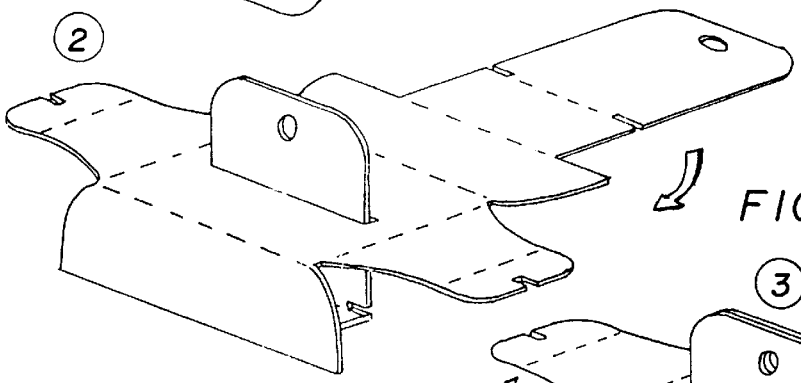
FIG. 4 illustrates secondary steps of folding the bottom section and tab of the front segment and passing the tab through the slot in the top section of the carton.
Figure 5:
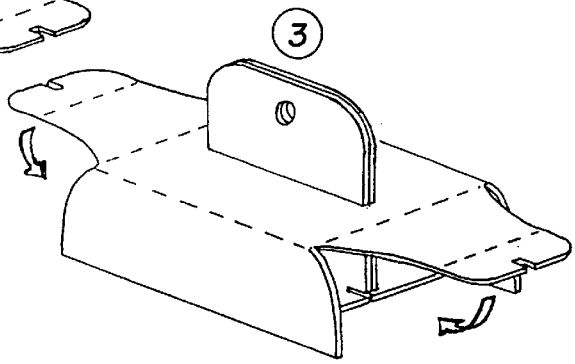
FIG. 5 illustrates the result of repeating the steps for the back segment and shows the folding downward of the lateral segments of the carton.
Figure 6:
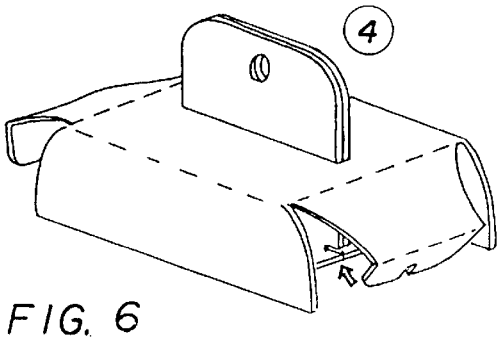
FIG. 6 illustrates the folding of each lateral segment to complete the carton.
Figure 7:
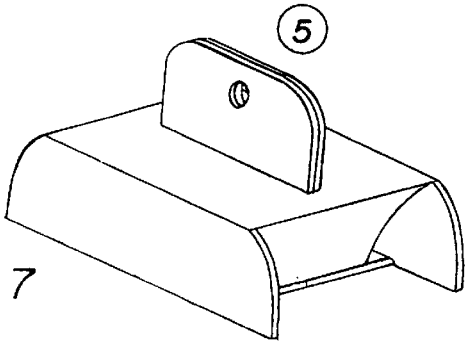
FIG. 7 is a perspective view of the assembled carton of the invention shown without stirrups.

The top section 12 of the article 10 is substantially rectangular with a width 22 suitable for covering the curved portion of a stirrup and a depth 24 sufficient to shroud two upright stirrups standing in parallel and side by side as illustrated in FIG. 2. The longitudinal segments 14 and 16 of the article 10 include approximately trapezoidal back and front sections 26 and 28, respectively, connected to the top section 12 along the narrower side of the trapezoid. The height 30 of the back and front sections 26,28 is selected to be at least equal to, but preferably somewhat larger than, the thickness of the curved portion of the stirrup for which the carton is intended, so that a snug loop can be formed around it. The longitudinal segments 14,16 further include substantially rectangular bottom sections 32 and 34, each having a depth 36 approximately equal to half the depth 24 of the top section 12 and a width 38 suitable for looping under the curved portion of the stirrup. Finally, the longitudinal segments 14,16 include substantially rectangular elongated tabs 40 and 42 with distal ends 44 and 46, respectively, containing catch or hanging holes 48 suitable for receiving a hook of a display rack. The distal ends 44,46 are intended for passing upward through a centrally located, narrow, transverse retaining slot 50 in the top section 12 of the carton, such that the catch holes 48 are easily accessible for use from above the top section 12. Therefore, the length 52 of the transverse slot 50 must be commensurate with the width 38 of the distal ends 44,46, while its width is preferably about twice the thickness of the material of the carton 10 to provide a snug fit of the pair of elongated tabs 40,42 in the retaining slot 50. It is noted that the width of the distal ends 44,46, the elongated tabs 40,42 and the bottom sections 32,34 is the same for simplicity of design and illustration, but it could be different in equivalent embodiments of the invention. The height 54 of the elongated tabs 40,42 must be sufficiently greater than the height 30 of the back and front sections 26,28 to allow the emergence of the distal ends 44,46 and the catch holes 48 from the slot 50 when the carton is assembled. Finally, two lateral cuts 56 are provided in each of the elongated tabs 40,42 at the boundary with the bottom sections 32,34, to which they are connected. Each cut 56 has a width 57 approximately equal to, and preferably slightly greater than, the thickness of the material used to manufacture the article 10 of the invention.

The lateral segments 18,20 of the article 10 also include approximately trapezoidal side sections 58 and 60 connected to the top section 12 along the wider side of the trapezoid. The height 62 of the side sections is substantially the same as the height 30 of the back and front sections 26,28, while the trapezoid's narrower side is selected to be sufficiently smaller than the wider side to permit the stirrup to protrude therethrough when the carton is assembled, as illustrated in FIG. 2. The purpose of the side sections 58,60 is both aesthetic, to cover the retaining loops formed by the longitudinal segments 14,16, and functional, to provide a partition between the tops of the two stirrups to keep them in snug alignment with their respective loops in the package. The lateral segments 18,20 further include substantially rectangular latch sections 64,66 connected to the narrower base of the trapezoidal sections 58,60. Each latch section contains an axial slit 68 with a width 69 slightly larger than twice the thickness of the material used for making the article 10 of the invention. The width 70 of the latch sections 64,66 is preferably the same as the narrower side of the trapezoidal sections 58,60, while their depth 72 is chosen large enough to provide sufficient frictional engagement with the elongated tabs 40,42 when the slits 68 are connected to the lateral cuts 56 during assembly. Although not required, staples and/or adhesives may be used to reinforce the connection, if desired. First, second and third fold lines 74, 76 and 78, respectively, are provided in the longitudinal segments 14,16 of the invention; similarly, first and second fold lines 80 and 82, respectively, are provided in the lateral segments 18,20 for forming the carton during assembly.

As seen in FIG. 2 and also illustrated by the intermediate steps shown in FIGS. 3–7 (without stirrups), the stirrups S are packaged in the article 10 of the invention in pairs such that they hang from the packaging wrapped around the curved portion C of each stirrup, such that each stirrup straddles a bottom portion of the longitudinal segments. The carton 10 of the invention shrouds the upper curved portions C while leaving open and visible the branches B and the foot-pads P of the pair of stirrups, such that they can stand upright or hang by the holes 50 as a package. The process of forming the package around the pair of stirrups is carried out by first folding the back and front sections 26,28 downward along fold lines 74; then folding the bottom sections 32,34 inward along fold lines 76 while beginning to form a loop around the bottom of each curved portion C of the stirrups standing side by side; then folding the elongated sections 40,42 upwards along fold lines 78 to complete the loops around the stirrups and passing the distal ends 44,46 through the slot 50 to emerge above the top section 12 and make the hanging holes 48 available for use. Next, the two side sections 58,60 are folded downward along fold lines 80 and inserted between the two stirrups as a separation between them that provides a firmer assembly to the package. Finally, the two latch sections 64,66 are folded inward along fold lines 82 and are connected to the top of the bottom sections 32,34 by latching the lateral cuts 56 to the slits 68 in frictional engagement. Again, if desired, or necessary because inadequately rigid material is used with relatively heavy stirrups, adhesives or other equivalent fastening means can be used to further reinforce the connection. Similarly, the two distal ends 44,46 protruding from the retaining slot 50 may be glued or stapled together to further strengthen the package. In the preferred embodiment of the invention, though, relatively rigid cardboard is used and no additional fastening means are required.

Figure 10:
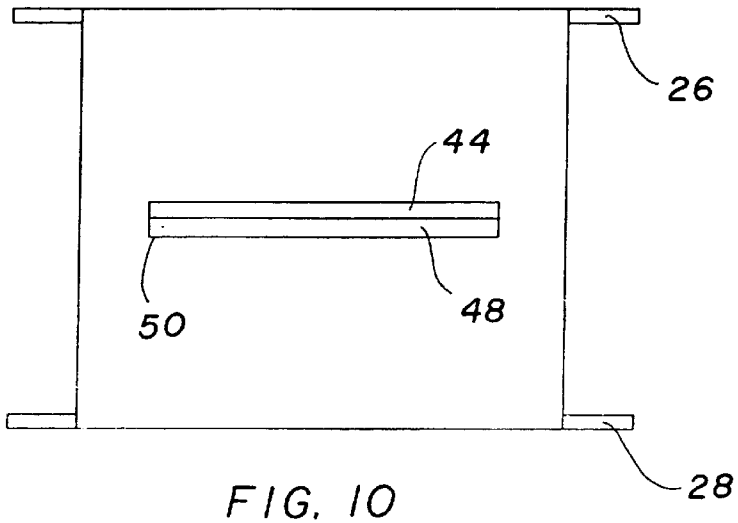
FIG. 10 is a top plan view of the assembled carton of FIG. 7.
Figure 8:
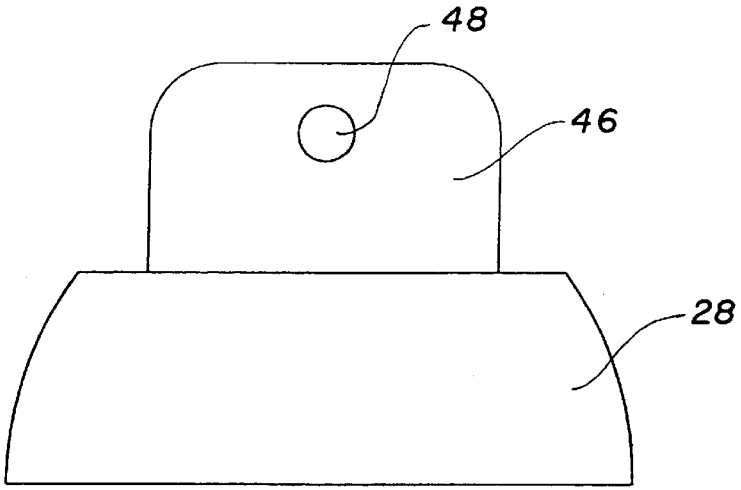
FIG. 8 is a front elevational view of the assembled carton of FIG. 7.
Figure 9:
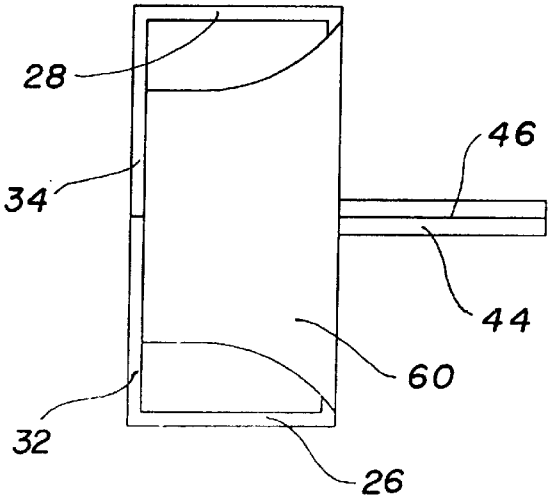
FIG. 9 is a side elevational view of the assembled carton of FIG. 7.

FIGS. 8–10 show a front, side and top view of the carton 10 of the invention assembled without stirrups. In the preferred embodiment, shown in all figures, the carton 10 is made from a single piece of cardboard approximately 1.5 mm thick. The sides of the approximately trapezoidal front, back and side sections 28,26,58,60 are slightly curved to provide a better fit aesthetically and structurally around the curved top portions C of the stirrups. As clearly visible in FIG. 2, the sides of the front and back sections 28,26 are preferably curved to conform to the curvature of top portions C the stirrups, while the sides of the side sections 58,60 are curved to conform to the cross-sectional curvature of such portions of the stirrups. In a design suitable for packaging most commercial stirrups, the top section 12 is 70 mm wide and 60 mm deep, with a slot 50 that is 50 mm long and 5 mm wide. The front and back sections 28,26 have a top side 70 mm wide, a larger bottom side 90 mm wide, a height of 30 mm, and curved sides with an inward radius of curvature of 50 mm. Each bottom section 32,34 is 50 mm wide and 28 mm deep.

Each elongated tab 40,42 is 50 mm wide and 60 mm high, and contains a hanging hole 48 that has a diameter of 8 mm and is centered 10 mm from the distal end of the tab. The lateral cuts 56 are about 2.5 mm wide (slightly greater than the cardboard thickness because a portion of each cut's width is lost in the fold) and 9 mm long. The side sections 58,60 have a top side 60 mm wide, a narrower bottom side 36 mm wide, a height of 30 mm, and sides with an upper curved portion with a radius of curvature of about 20 mm. Finally, the latch sections 64,66 are 36 mm wide and 15 mm deep, and the slits 68 are 5 mm wide and 5 mm long.

It is noted that the specific shape of the various sections is not critical so long as adequate to provide tabs suitable for looping around the curved top portions of the stirrups and passing through the retaining slot in the top section of the carton clearing the hanging holes for use. It is also clear that the specific design of the packaging carton 10 must be tailored to the dimensions of the stirrups S for which it is intended. Thus, the height 30 of the front and back sections 28,26 and the height 62 of the side sections 58,60 must be approximately the same as the portion C of the stirrups to be covered and wrapped, as a function of which the width of the bottom sections 32,34 is also determined because they must fit between the branches of each stirrup. Similarly, the bottom side of the side sections 58,60 must be sufficiently narrow to fit between the pair of stirrups.

The resulting package, seen in FIG. 2, consists of two stirrups securely and visibly contained within a carton that can be hung on a display rack through the holes 48. Although loosely held, it is apparent that the stirrups cannot be removed from the carton without first unlatching the latch sections 64,66 from the lateral cuts 56 in the elongated tabs 40,42 and unfolding the tabs to free the curved portions C of the stirrups.

Various changes in the details, steps and components that have been described may be made by those skilled in the art within the principles and scope of the invention herein illustrated and defined in the appended claims. For example, material other than cardboard could readily be used so long as sufficiently rigid to provide support to the carton and suitable for bending along designated fold lines. Similarly, the front and back sections of the carton, as described, are obviously interchangeable because no distinguishable functional significance can be attributed to the front and back of the carton. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent processes and products.

I claim:

1. A foldable carton for packaging a pair of stirrups, where each stirrup consists of a top curved portion forming spaced-apart branches connected to a bottom foot pad, the carton comprising:

a top section adapted to cover the top curved portions of the pair of stirrups when positioned standing side by side, said top section including a narrow slot;

first fastening means attached to the top section for engaging a first stirrup by forming a first loop around the top curved portion thereof and by securing the first loop by passing a first distal portion of said first fastening means through the slot in the top section;

second fastening means attached to the top section for a engaging a second stirrup by forming a second loop around the top curved portion thereof and by securing the second loop by passing a second distal portion of said second fastening means through the slot in the top section;

catch means in said first and second distal portions of the fastening means for hanging the carton;

wherein the catch means is positioned such that it protrudes above the slot in the top section after packaging of the pair of stirrups.

2. The carton of claim 1, wherein said first and second fastening means consist of substantially identical structures symmetrically disposed with respect to the top section.

3. The carton of claim 1, further comprising first and second partition means for keeping the top curved portions of the stirrups in snug alignment in the carton.

4. The carton of claim 3, wherein said first and second fastening means consist of substantially identical tab structures symmetrically disposed with respect to the top section along a longitudinal axis thereof; and wherein said first and second partition means consist of substantially identical partition structures symmetrically disposed with respect to the top section along a transverse axis thereof.

5. The carton of claim 1, wherein said first and second fastening means consist of substantially identical structures symmetrically disposed with respect to the top section along a longitudinal axis thereof; wherein said first fastening means consists of a first longitudinal segment comprising a back section connected to said top section, a first bottom section connected to the back section, and a first elongated tab connected to the bottom section and having a first distal end adapted for insertion through the slot in the top section; and wherein said second fastening means consists of a second longitudinal segment comprising a front section connected to said top section, a second bottom section connected to the front section, and a second elongated tab connected to the second bottom section and having a second distal end adapted for insertion through the slot in the top section.

6. The carton of claim 5, further comprising first and second partition means for keeping the top curved portions of the stirrups in snug alignment in the carton, each of said partition means consisting of substantially identical partition structures symmetrically disposed with respect to the top section along a transverse axis thereof.

7. The carton of claim 6, wherein each of said elongated tabs includes two lateral cuts at the boundary with the corresponding bottom sections; and wherein each of said partition structures comprises a side section connected to the top section, and a latch section connected to the side section and having a slit adapted to provide frictional engagement with said lateral cuts in the elongated tabs.

8. The carton of claim 7, wherein said front and back sections are substantially trapezoidal with a narrow base connected to the top section; and wherein said side sections are substantially trapezoidal with a wide base connected to the top section.

9. The carton of claim 8, wherein said carton has a uniform thickness, said narrow slot in the top section and said slits in the latch sections have a width about twice said thickness, and said lateral cuts in the elongated tabs have an effective width slightly less than said thickness.

10. The carton of claim 9, wherein said catch means consists of a hanging hole in each of the distal ends of the elongated tabs.

11. The carton of claim 1, wherein said top section, said first and second fastening means, and said catch means consist of an integral, unitary piece of material.

12. The carton of claim 11, wherein said material is cardboard.

13. A method of packaging a pair of stirrups in a foldable a carton, where each stirrup consists of a top curved portion forming spaced-apart branches connected to a bottom foot pad, comprising the following steps:

(a) providing a foldable carton comprising:

a top section adapted to cover the top curved portions of the pair of stirrups when positioned standing side by side, said top section including a narrow slot;

first fastening means attached to the top section for engaging a first stirrup and including a first distal portion adapted for insertion through the slot in the top section;

second fastening means attached to the top section for engaging a second stirrup and including a second distal portion adapted for insertion through the slot in the top section;

catch means in said first and second distal portions of the fastening means for hanging the carton;

(b) placing the top section of the carton over the curved ends of two stirrups positioned upright and side by side;

(c) folding the first fastening means downward and inward around one stirrup and passing the first distal end upward through the narrow slot in the top section; and (d) folding the second fastening means downward and inward around the other stirrup and passing the second distal end upward through the narrow slot in the top section alongside said first distal end.

14. The method of claim 13, further comprising the steps of:

including two lateral cuts in each of said first and second fastening means;

providing first and second partition means attached to the top section for keeping the top curved portions of the stirrups in snug alignment in the carton, each of said partition means containing a distal latch section having a slit adapted to provide engagement with said lateral cuts in the elongated tabs;

folding each of said partition means downward and inward to separate the stirrups; and latching the slit in each of the distal latch sections in engagement with said lateral cuts.

15. The method of claim 14, wherein said first and second fastening means consist of substantially identical fastening structures symmetrically disposed with respect to the top section along a longitudinal axis thereof; and wherein said first and second partition means consist of substantially identical partition structures symmetrically disposed with respect to the top section along a transverse axis thereof.

16. The method of claim 13, wherein said catch means consists of a hanging hole in each of the distal portions of the fastening means.

17. The method of claim 14, wherein said top section, first and second fastening means, and first and second partition means consist of an integral, unitary piece of material.

* * * * *